US007841934B2

(12) United States Patent
Gauselmann

(10) Patent No.: US 7,841,934 B2
(45) Date of Patent: Nov. 30, 2010

(54) AMUSEMENT MACHINE HAVING A SECONDARY GAME FOR DETERMINING A WINNING AMOUNT

(75) Inventor: Michael Gauselmann, Espelkamp (DE)

(73) Assignee: Atronic International GmbH, Lübbecke (DE)

( * ) Notice: Subject to any disclaimer, the term of this patent is extended or adjusted under 35 U.S.C. 154(b) by 280 days.

(21) Appl. No.: 10/142,210

(22) Filed: May 8, 2002

(65) Prior Publication Data

US 2003/0008700 A1 Jan. 9, 2003

(30) Foreign Application Priority Data

Jul. 6, 2001 (DE) ..... 101 32 381

(51) Int. Cl.
*A63F 9/24* (2006.01)

(52) U.S. Cl. ..... 463/20; 463/16

(58) Field of Classification Search ..... 463/16, 463/20; 273/143 R

See application file for complete search history.

(56) References Cited

U.S. PATENT DOCUMENTS 4,804,185 A * 2/1989 Noble et al. ..... 463/11
5,092,598 A * 3/1992 Kamille ..... 273/139
5,205,555 A * 4/1993 Hamano ..... 273/143 R
5,769,716 A * 6/1998 Saffari et al. ..... 463/20
6,135,884 A * 10/2000 Hedrick et al. ..... 463/20
6,270,405 B1 * 8/2001 Ferguson ..... 463/13
6,270,412 B1 * 8/2001 Crawford et al. ..... 463/20
6,364,766 B1 * 4/2002 Anderson et al. ..... 463/16
6,533,273 B2 * 3/2003 Cole et al. ..... 273/138.1

FOREIGN PATENT DOCUMENTS

DE 198 42 128 A 1 3/2000
DE 199 61 000 A 1 6/2001
GB 2 086 632 A 5/1982
GB 2 296 360 A 6/1996

* cited by examiner

*Primary Examiner*—Corbett B Coburn
(74) *Attorney, Agent, or Firm*—Patent Law Group LLP; Brian D. Ogonowsky

(57) ABSTRACT

The gaming device comprises a main game, which results in random outcomes. At least one of the outcomes enables a secondary game. Indicia are selected and displayed in the secondary game. A player positions the indicia of the secondary game by operating controls. A pay out to the player is made based on the indicia and their positions selected by the player.

22 Claims, 3 Drawing Sheets

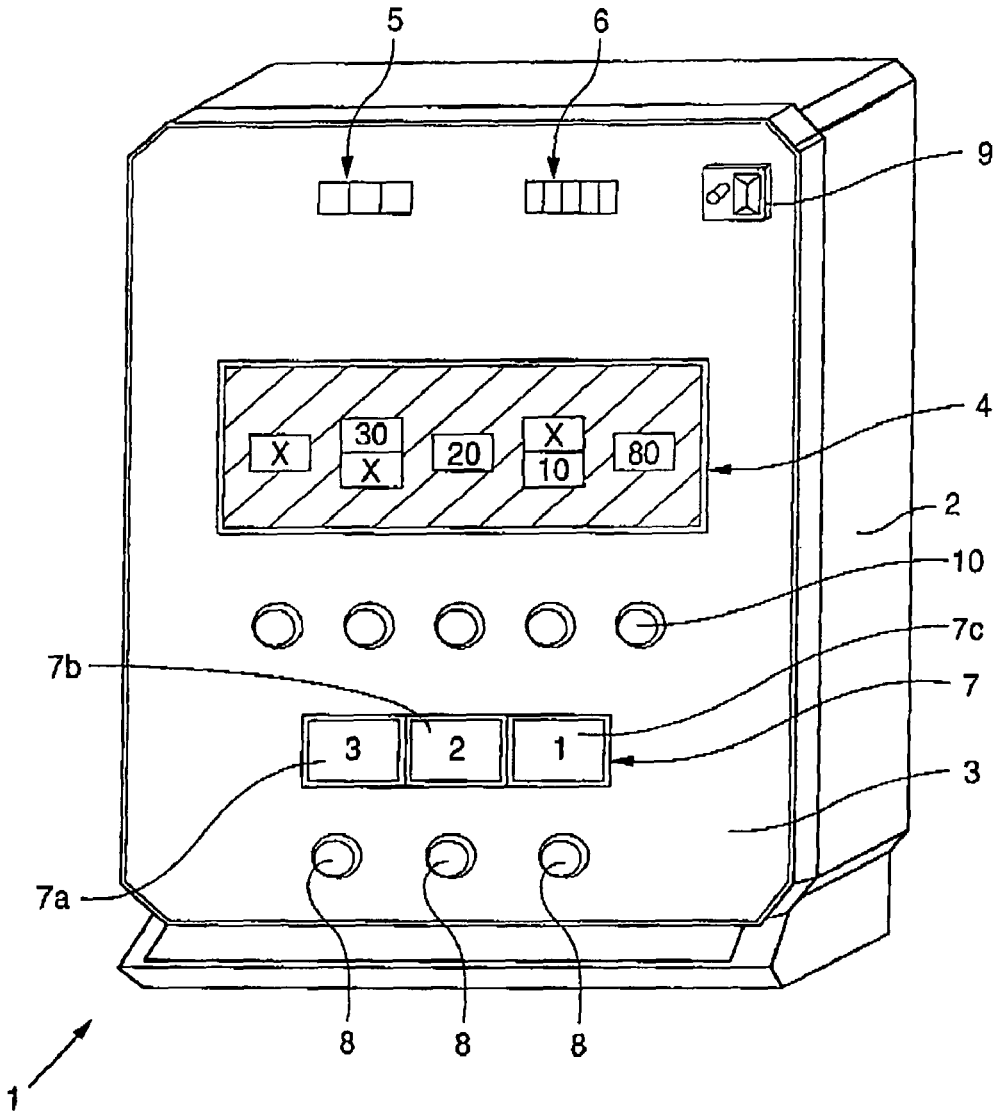
FIG. 1
FIG. 4
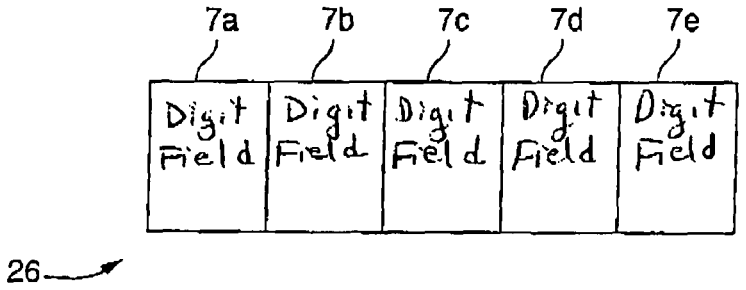

AMUSEMENT MACHINE HAVING A SECONDARY GAME FOR DETERMINING A WINNING AMOUNT

FIELD OF INVENTION

The invention relates to a device for the determination of a winning amount on an amusement machine and specifically to a device for the determination of a bonus amount in a secondary game.

BACKGROUND

From the publication DE 198 42 128.A1, a coin operated amusement machine with a jackpot device is known. The coin-operated amusement machine comprises a symbol gaming device and a display with several digits to display the credit value. Furthermore, the coin operated amusement machine comprises a display with several digits corresponding to a jackpot value for obtaining a certain jackpot symbol combination. By operating the control elements, a jackpot symbol combination may be changed by a player. The player wins the jackpot value if the symbols randomly selected by the machine matches the player-selected jackpot symbol combination. The disadvantage of this invention is that a decision to change the jackpot symbol combination is not available for each game, so that the player is only seldom actively and strategically involved in the game.

The present invention solves this problem by guaranteeing active player interaction at regular intervals.

SUMMARY

The gaming device in accordance with one embodiment of the present invention comprises a main game, which results in random outcomes. At least one of the outcomes enables a secondary game. The secondary game is activated, and indicia of the secondary game are displayed. A player positions the indicia of the secondary game by operating control elements. Once all the indicia of the secondary game are positioned, a pay out to the player is made based on the order and combination of the indicia.

BRIEF DESCRIPTION OF THE DRAWINGS

FIG. 1 shows the front of an amusement machine in accordance with one embodiment of the present invention.

FIG. 4 shows a display device in accordance with one embodiment of the present invention.

DETAILED DESCRIPTION

Figure 2:
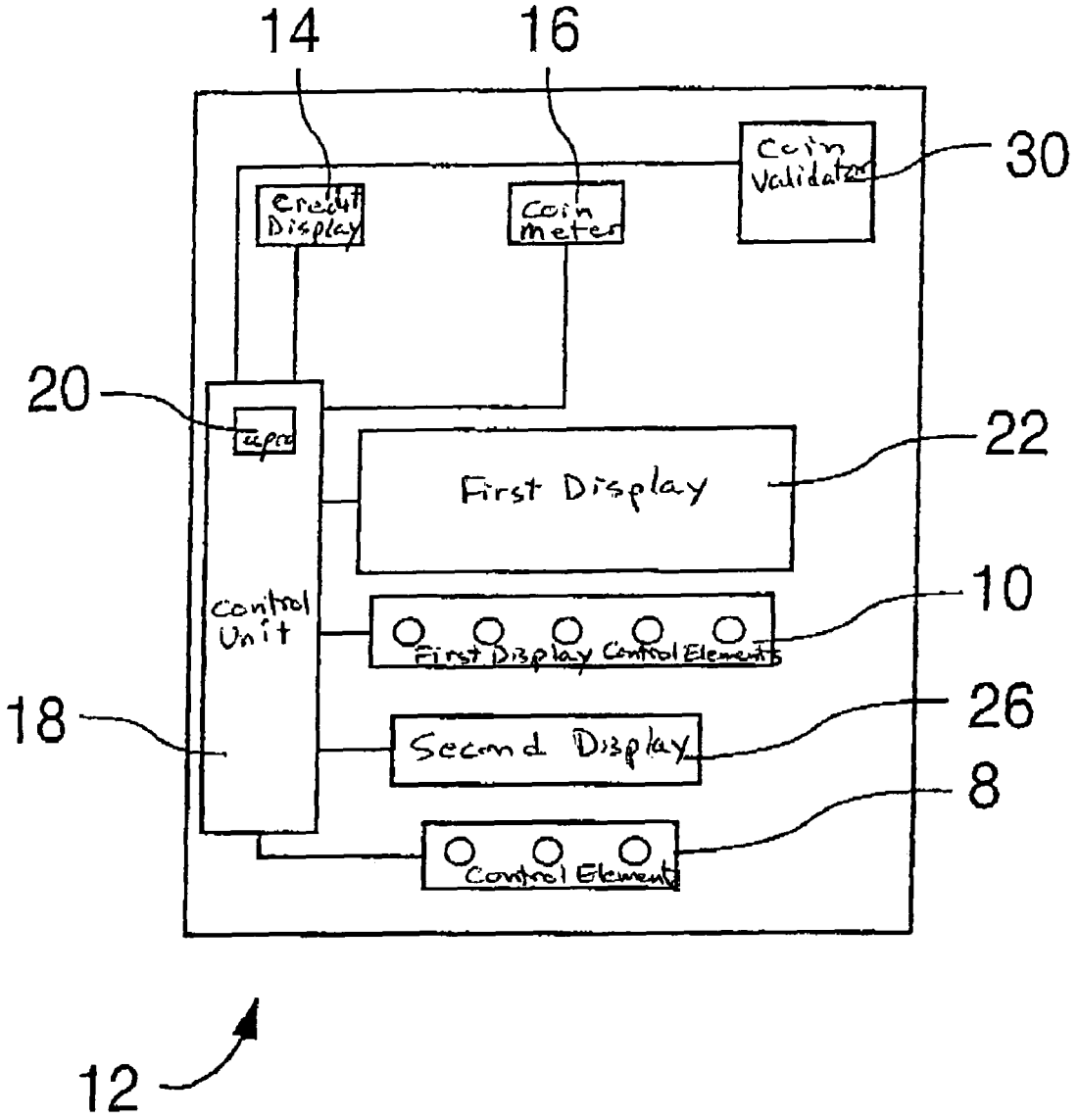
FIG. 2 is a block diagram of an amusement machine in accordance with one embodiment of the present invention.

FIG. 1 shows a coin-operated amusement machine 1 in accordance with one embodiment of the present invention. It should be understood that the present invention may be used with amusement machines operated with other kinds of credit such as bills, credit/debit cards, or bar codes associated with credit. Amusement machine 1 comprises a housing 2 with a front 3, which is built as a door. Front 3 comprises windows 4, 5, 6, and 7. Window 5 displays the credit value available to a player. Window 6 displays the value of coins inserted into a coin slot 9. Window 4 displays the symbols of a first game.

FIG. 1 shows a video reel type game, where certain symbol combinations in window 4 are winning combinations.

Underneath window 4, there are game control elements 10, which are connected to a control unit 18 (see FIG. 2). By activating game control elements 10, the game shown through window 4 can be played.

Underneath control elements 10 there is a window 7, which displays three digit fields 7*a*-7*c*. In other embodiments, window 7 may display more or less digits or other symbols. A control element 8 is associated with each of the digit fields 7*a*-7*c* displayed behind window 7. Control elements 8 are connected to control unit 18 (see FIG. 2) of amusement machine 1.

FIG. 2 is a block diagram 12 of various components of amusement machine 1 in FIG. 1. A credit value display device 14 is located behind window 5 (FIG. 1) and displays the credit value available to a player. A coin meter device 16 is located behind window 6 (FIG. 1) and displays the value of coins inserted into amusement machine 1. Credit value display device 14 and coin meter device 16 are connected to control unit 18, which comprises a microcomputer 20. Credit value display device 14 and coin meter device 16 may be LCD displays, mechanical counters, or some other device that displays numbers.

A first game display device 22 is located behind window 4 and is used to display game symbol combinations. First game display device 22 can be mechanical wheels, reels, flip cards, dice, a CRT, an LCD, an LED display, or other type of display. Additionally, transparent, backlit pictures of digits can be used. First game control elements 10 are connected to control unit 18 and are used to play the game displayed on first game display device 22.

A second game display device 26 is located behind window 7 and displays the digit fields 7*a*-7*c* of the second game. Second game display device 26 may be mechanical wheels, reels, flip cards, dice, a CRT, an LCD, an LED display, or other type of display. Control elements 8 are connected to control unit 18. In an alternative embodiment, a plurality of display devices may be used to display the individual digit fields 7*a*-7*c*.

In yet another embodiment, a single display device may be used instead of first game display device 22 and second game display device 26. The single display device may be separated into two regions, with one region displaying the game symbol combinations of first game display device 24 and a second region displaying the digits of second game device 26.

Coin entry 9 (FIG. 1) is coupled to a coin validator 30 (FIG. 2) that forwards the coins into a coin hopper (not shown). Coin validator 30 determines the value of the accepted coins and sends this value to control unit 18. Control unit 18 sends a signal to coin meter 16 to register the value of the accepted coins.

Figure 3:
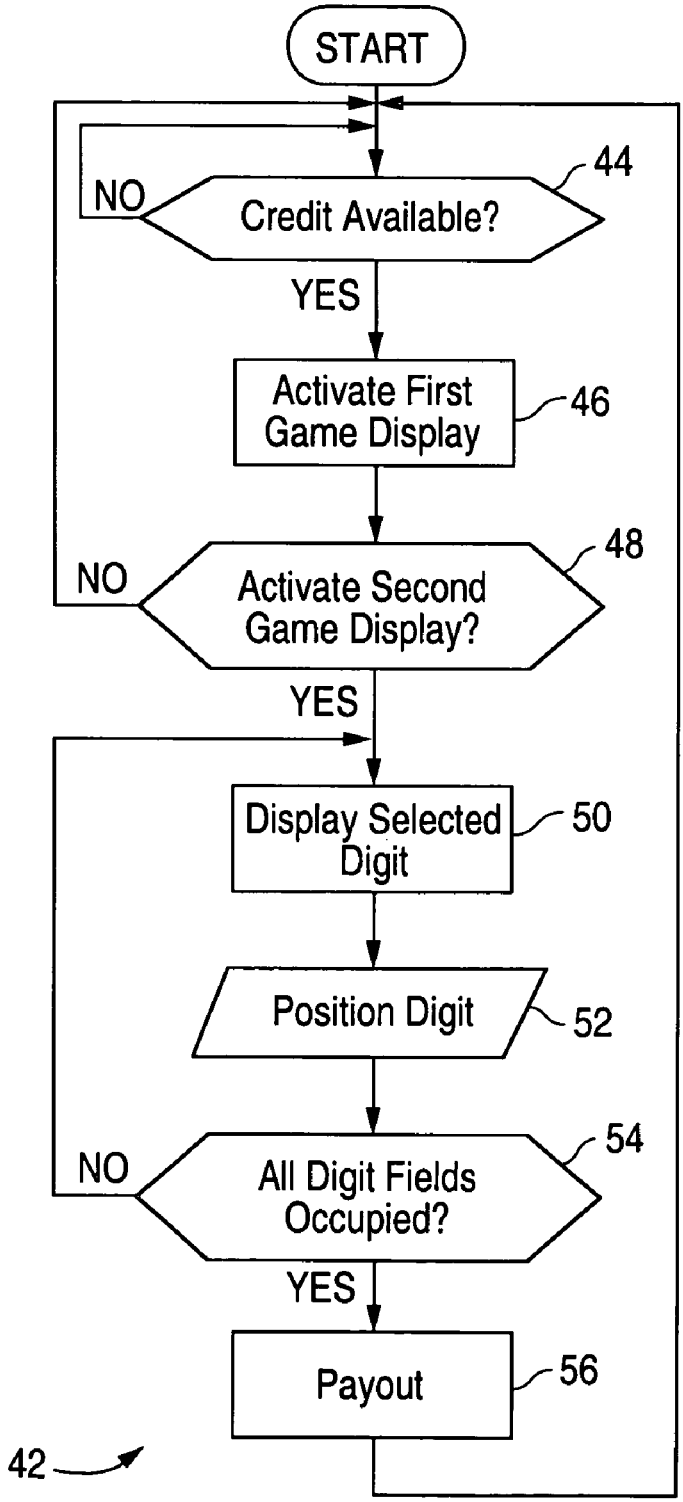
FIG. 3 is a flow chart that describes a game sequence in accordance with one embodiment of the present invention.

FIG. 3 is a flow chart 42 of a process of playing a game in accordance with one embodiment of the present invention. At step 44, a change of coin meter 16 prompts control unit 18 to check if the actual value on coin meter 16 corresponds to the necessary credit for game play. If there is enough credit for game play, at step 46, the first game display device 22 behind window 4 activated. Control unit 18 determines, at random, a symbol combination, which is displayed by first game display device 22.

At step 48, control unit 18 checks if the displayed symbol combination is a winning combination. If a specially marked winning combination according to a pay table is displayed, second game display device 26 (FIG. 2), located behind window 7, is activated as part of the bonus game. The pay table is stored in a memory device connected to control unit 18, as is well known in the art. The specially marked combination may include a special symbol or special combination that gives rise to the bonus or secondary game. An award may also be paid immediately upon obtaining the specially marked winning combination.

At step 50, to play the bonus game in one embodiment, a digit is displayed by first game display device 22. Microcomputer 20 selects the digit from a predetermined range, for example, 0-9, using a pseudo random number generator program.

In one embodiment, first game display device 22 is able to display both symbols and digits. In one embodiment, an LCD monitor is used as first game display device 22, and control unit 18 controls the monitor to display selections of symbols or digits. In an alternative embodiment, mechanical reels are used as first game display device 22. In order to display both symbols and digits, two concentric mechanical reels are used. The outer reel displays symbols and comprises at least one hole. Through the hole in the first reel, the digits displayed on the second wheel can be seen. In yet another embodiment, flip cards may comprise both digits and symbols.

At step 52, a player positions the selected digit (or other indicia) on second game display device 26, using one of second game control elements 8 (e.g., buttons). The digit is then transferred from first game display 22 to the selected digit field on second game display 26. Control unit 18 then checks if all digit positions are occupied, at step 54. If there is a digit field 7*a*-7*c*, that is not occupied, the process loops back to step 50, where microcomputer 20 draws another digit. The second digit is then displayed on first game device 22 and is transferred to the position on second game display device 26 that the player has chosen. As shown at step 56, when all digit display fields 7*a*-7*c* are occupied, a winning bonus amount based on the digits drawn and their positions is paid out and added to credit meter 5, according to a pay table stored in control unit 18.

The award may be in the form of coins or other units, such as credits or encoding a card or paper ticket.

Each digit can be present several times, equal to the number of digit fields. For example, in the embodiment shown in FIG. 1 every digit within the predetermined range may be drawn three times, once for each digit field 7*a*-7*c*.

If desired, the predetermined range of digits used with the present invention can be limited in various ways. For example, the range may be limited to only the digits 4-8 for a particular draw, and that range is not available for further drawings. Alternatively, the digits may be programmed to be drawn from a single range, so that if drawn once they are not available for further drawings. A similar result may be achieved by taking out every drawn digit from the range available for the next drawing.

In another embodiment, the player selects the indicia (from a set of indicia) to use in the bonus game and then selects the positions of the indicia. The pay table varies from game to game. The player may select the indicia using buttons, a touch screen, or by other means.

In one embodiment, after the bonus game, the pay table for that bonus game is displayed to the player on a video screen so the player may see what she would have won using different positions of the indicia or using different indicia.

FIG. 4 illustrates another embodiment of the present invention. Second game display device 26 displays five digit fields 7*a*-7*e*. Digits for the three digit fields in the middle fields 7*b*-7*d* are drawn and positioned according to the process illustrated in the flow chart 42. A mystery game run by control unit 18 is then started to determine which outer (field 7*a* or 7*e*) position will be activated. The mystery game is displayed in window 4 on first game display device 24. The mystery game may comprise generating combinations of symbols and/or digits. A particular combination of symbols may represent activating the first field 7*a*, whereas a different combination may represent activating the last field 7*d*. Alternatively, the mystery game may simply draw a digit that represents the field to be activated.

After it is determined whether the first or last position is activated, an additional digit is drawn to occupy the activated field. The payout is then made according to a pay table as shown in step 56 of flow chart 42. Alternatively, four of the five or all five digit fields shown in FIG. 4 may be occupied according to the process of flow chart 42.

Although an embodiment of the invention has been described using digits in the secondary (or bonus) game, any indicia, instead of digits, may be randomly selected. Such indicia may include fruit symbols, shapes, or any other type of indicia. The player may select the position of the indicia using the control elements 8.

The device of the present invention has the advantage of the player actively participating in the game by being prompted to determine the positions of indicia in a display device. By the continued active participation of a player, a very high degree of tension and entertainment is achieved. Immediately after the positioning of the respective randomly determined indicia the player gets to know the result of his active participation. Because the consequences of the decision are shown immediately after the decision, the device of the present invention features active integration of the player at an amusement machine and grants to the player recurring game tension. In contrast to prior art devices that allow the player to select the jackpot symbol combinations, Applicant's specially marked symbol combinations can occur much more frequently than jackpot symbol combinations and involve more player involvement.

The concepts of this invention may be applied to other types of bonus games where the player positions selected indicia in the hopes of obtaining a maximum award.

While particular embodiments have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A gaming method comprising:

conducting a main game by a gaming machine controlled by a programmed microprocessor to obtain one of a plurality of outcomes, at least one of said outcomes enabling a secondary game, also conducted by the gaming machine controlled by the programmed microprocessor;

selecting indicia for said secondary game and revealing the indicia to a player;

after revealing the indicia to the player, arranging said indicia in a display in response to the player designating particular positions of said indicia so as to create a combination of the indicia in a particular arrangement;

determining, from the particular arrangement of the indicia created by the player, using a pay table that varies from secondary game to secondary game and in which different arrangements of the same indicia may pay different award amounts from secondary game to secondary game, an award amount associated with the particular arrangement, where different arrangements of the indicia correspond to different non-zero award amounts; and providing an award amount to said player determined by said particular arrangement, based on a correspondence between the particular arrangement and the award amount in the pay table.

2. The gaming method of claim 1 wherein said indicia are digits.

3. The gaming method of claim 1 wherein said selecting indicia comprises selecting indicia by the microprocessor.

4. The gaming method of claim 1 wherein said selecting indicia comprises selecting indicia by said player.

5. The gaming method of claim 1 wherein said indicia are selected pseudo randomly.

6. The gaming method of claim 5 wherein once a first indicia is selected, it may not be selected again during said secondary game.

7. The gaming method of claim 1 wherein said arranging comprises receiving signals from said player activating control elements for selecting a position of each selected indicia in said secondary game.

8. The gaming method of claim 1 wherein said conducting said main game comprises displaying said main game on a first display, and said arranging said indicia comprises positioning said indicia on a second display.

9. The gaming method of claim 1 wherein said indicia positioned by said player is displayed on a video monitor.

10. The gaming method of claim 1 wherein said indicia positioned by said player is displayed by flip cards.

11. The gaming method of claim 1 wherein said selecting indicia comprises selecting indicia by mechanical reels.

12. The gaming method of claim 1 wherein said at least one of said outcomes enabling a secondary game also provides an award amount.

13. A gaming device comprising:

at least one processor programmed to carry out the following method:

conducting a main game to obtain one of a plurality of outcomes, at least one of said outcomes enabling a secondary game;

selecting indicia for said secondary game and revealing the indicia to a player;

after revealing the indicia to the player, receiving signals from the player input for arranging said indicia in a display so as to create a combination of the indicia in a particular arrangement;

determining, from the particular arrangement of the indicia created by the player, using a pay table that varies from secondary game to secondary game and in which different arrangements of the same indicia may pay different award amounts from secondary game to secondary game, an award amount associated with the particular arrangement, where different arrangements of the indicia correspond to different non-zero award amounts; and providing an award amount to said player determined by said particular arrangement, based on a correspondence between the particular arrangement and the award amount in the pay table.

14. A gaming device comprising:

a display for displaying operation of a main game to obtain one of a plurality of outcomes, at least one of said outcomes enabling a secondary game;

a selector for selecting indicia for said secondary game and displaying identities of the indicia to a player;

player-operated controls for enabling said player to arrange the indicia from said secondary game, after the identities of the indicia are displayed to the player, so as to create a combination of the indicia in a particular arrangement;

a detection device for determining, from the particular arrangement of the indicia created by the player, using a pay table that varies from secondary game to secondary game and in which different arrangements of the same indicia may pay different award amounts from secondary game to secondary game, an award amount associated with the particular arrangement, where different arrangements of the indicia correspond to different non-zero award amounts; and an award device for providing an award amount to said player determined by said particular arrangement, based on a correspondence between the particular arrangement and the award amount in the pay table.

15. The gaming device of claim 14 further comprising a second display, which displays positioned indicia from said secondary game.

16. The gaming device of claim 14 wherein said indicia are digits.

17. The gaming device of claim 14 wherein said selector comprises a pseudo random number generator.

18. The gaming device of claim 14 wherein once an indicia is selected it cannot be selected again in said secondary game.

19. The gaming device of claim 14 wherein said display comprises a video monitor.

20. The gaming device of claim 14 wherein said display comprises a collection of flip cards.

21. The gaming device of claim 14 wherein said display comprises mechanical reels.

22. The gaming device of claim 14 wherein said controls are buttons.

* * * * *